United States Patent [19]

Gilbert

[11] 4,167,810

[45] Sep. 18, 1979

[54] CUTTING TOOL

[75] Inventor: Richard Gilbert, Dronfield, England

[73] Assignee: Stanley Tools Limited, Sheffield, England

[21] Appl. No.: 838,315

[22] Filed: Sep. 30, 1977

[30] Foreign Application Priority Data

Oct. 4, 1976 [GB] United Kingdom ..... 41153/76

[51] Int. Cl.[2] ..... B26B 3/08; B26B 29/00

[52] U.S. Cl. ..... 30/2; 30/294

[58] Field of Search ..... 30/2, 286, 287, 294, 30/295

[56] References Cited

U.S. PATENT DOCUMENTS

| | | | |
|---|---|---|---|
| 561,092 | 6/1896 | Cooke | 30/294 |
| 1,821,718 | 9/1931 | Melcher | 30/2 |
| 2,085,681 | 6/1937 | Lichty | 30/295 |
| 2,660,787 | 12/1953 | Parker | 30/294 X |
| 3,178,812 | 4/1965 | Lurie | 30/2 |

FOREIGN PATENT DOCUMENTS

| | | | |
|---|---|---|---|
| 2402961 | 1/1975 | Fed. Rep. of Germany | 30/294 |
| 410786 | 6/1945 | Italy | 30/294 |
| 681837 | 10/1952 | United Kingdom | 30/286 |

*Primary Examiner*—Gary L. Smith

*Attorney, Agent, or Firm*—Prutzman, Kalb, Chilton & Alix

[57] ABSTRACT

A cutting tool for sheet material, especially for opening cardboard cartons, has a disposable blade removably fixed to a handle and a guide member of bent wire also fixed to the handle for keeping the blade in cutting engagement with the sheet material and away from the contents of the cartons. A nose of the guide member is rounded to avoid damaging the carton contents and projects ahead of the cutting edge of the blade. One arm of the guide member is above the blade tip so as to keep the blade from disengagement from the sheet material. Another arm of the guide member is below the tip of the blade for preventing cans or other cartons contents from being cut by the blade. A hard point is provided for puncturing cartons which are too tough to be punctured by the rounded nose of the guide member.

5 Claims, 36 Drawing Figures

14b'
14c'
15a
15
18
14
14c
19b
14b
14a
19a
16
13
19
10
13b
13a
12
11
11/1

14c'
14b'
14
14c
19b
14a
19a
19
13
15d
10
13b
13a
11
11/2

14c'
14b'
18
14b
14c
14a
19
13a
13b
11/2
11/1
10'

26
27
28
29
30
31
32
32a
32b
33
33a
33b
34
34a

CUTTING TOOL

FIELD OF THE INVENTION

This invention relates to cutting tools, especially to cutting tools suitable for cutting sheet material such as cardboard, cardboard cartons, carpets, linoleum and plastics floor coverings.

SUMMARY

As seen from one aspect of the invention there is provided a cutting tool for cutting sheet material, comprising a guide member and a cutting blade connected or connectable together in fixed relationship with the blade adjacent the guide member, the guide member having a smooth (i.e. not sharp) rounded nose projecting ahead of the cutting edge of the blade the tool also including a point which is pointed enough and strong enough for puncturing sheet material which is too tough to be readily punctured by the rounded nose of the guide member, the guide member being adapted to guide the blade so as to maintain the blade in cutting engagement with the sheet material being cut, and the guide member also being adapted to shield the blade from anything otherwise liable to be inadvertently cut near one side of the sheet material.

When using the cutting tool for opening cardboard cartons, it should be possible to avoid substantial damage to the contents of the carbon by virtue of the nose being smooth and rounded. However, some cartons may not be puncturable by the rounded nose because they are too tough for it, in which case the point can be used for puncturing the carbon.

The guide member may be made in several different ways, for example, from plastics, from bent wire, from cast metal or from two or more parts joined together, such as a metal pressing with a plastics nose insert.

A handle preferably either forms part of the cutting tool or is attachable to the cutting tool.

According to another aspect of the invention, there is provided a cutting tool for cutting sheet material comprising a guide member and a cutting blade connected or connectable together in fixed relationship with the blade adjacent the guide member, the guide member being made of bent wire to have a smooth rounded nose, the guide member being adapted to guide the blade so as to maintain the blade in cutting engagement with the sheet material being cut, and the guide member also being adapted to shield the blade from anything otherwise liable to be inadvertently cut near one side of the sheet material, the rounded nose of the guide member projecting ahead of the cutting edge of the blade.

A handle preferably either forms part of the cutting tool or is attachable to the cutting tool.

The guide member is preferably made from wire of circular cross section, but cross sectional shapes other than circular may be used, provided that attention is paid to the positioning or removal of any sharp edges.

Preferably, the guide member is in the form of a loop including two arms, a first one of the arms preferably having its upper surface above the level of the tip of the blade (as seen side on with the cutting direction horizontal and the guide member at the bottom) together with a lateral spread apart from the blade, and the second arm preferably having its lower surface below the level of the tip of the blade, (as seen side on with the cutting direction horizontal and the guide member at the bottom) and either or both of the two arms extended rearwards to connect the guide member to a support for the blade, with such extension or extensions formed so as to be substantially directly behind the blade.

It is to be understood that the above references to upper and lower surfaces, a horizontal cutting direction and the guide member at the bottom are to facilitate explanation and understanding and do not imply either that the cutting direction must be horizontal or that the tool must be used with the guide member at the bottom.

The lateral spread of the first arm of the guide member relative to the blade should ensure that the blade is maintained in engagement with the sheet material being cut. Hence, no special effort should be required to maintain the blade in cutting in engagement with the sheet material being cut, all that is required being a firm pulling action.

The amount of lateral spread of the first arm of the guide member and its proximity to the blade should depend upon the type and thickness of the material or materials intended to be cut by the tool. For instance, in a tool for cutting thin flexible sheet material the arm of the guide member should be closer to the blade than in a tool for cutting thicker, more rigid sheet material, in order that there be insufficient space between guide and blade member for the material to flex away from the tip of the blade and thereby avoid being cut right through. However, in a tool for cutting material such as cardboard it is desirable to arrange as far as is possible that at places where the guide member is closest to the blade, its shape is such as to minimise the tendency for pieces of cardboard to become clogged there. Thus, the actual shape and positioning of the guide member should depend upon what type and thickness of sheet material the tool is intended to cut.

The ease with which the tool can be pulled as it cuts depends in part upon the thickness of that part of the guide member which follows behind the blade in the cut made by the blade. The thickness of that said part of the guide member may be reduced either by removal of material or preferably by localised deformation of the guide member during manufacture.

DESCRIPTION OF PREFERRED EMBODIMENTS

Figure 5:
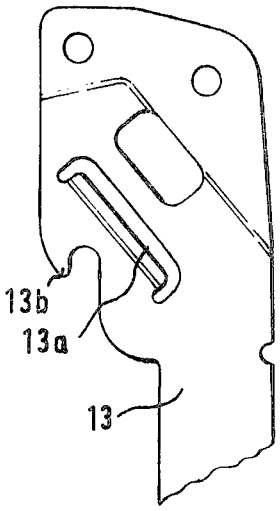
FIG. 5 is a side elevation of a carrier member forming part of the cutting tool of FIG. 1.
Figure 6:
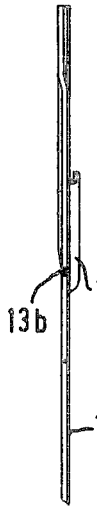
FIG. 6 is an edge-on view of the carrier member of FIG. 5.
Figure 7:
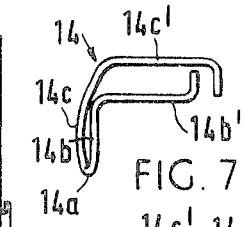
FIGS. 7, 8 and 9 are views of a guide member of the cutting tool of FIG. 1.
Figure 8:
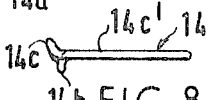
Figure 9:
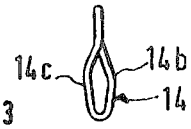
Figure 10:
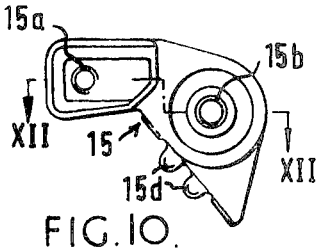
FIG. 10 is a side elevation of a locator member of the cutting tool of FIG. 1.
Figure 11:
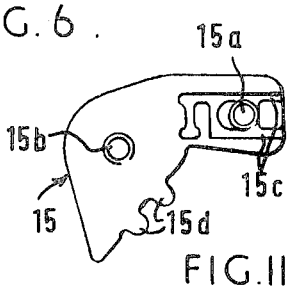
FIG. 11 is an opposite side elevation of the locator member of FIG. 10.
Figure 12:
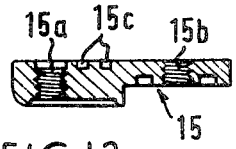
FIG. 12 is a section on line XII—XII of FIG. 10.
Figure 13:
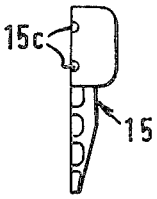
FIG. 13 is an end on view of the locator member.
Figure 14:
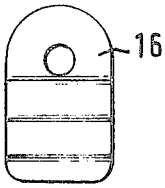
FIGS. 14 and 15 illustrate a clamp member of the cutting tool of FIG. 1.
Figure 15:
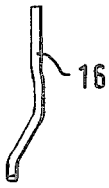
Figure 16:
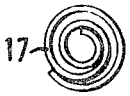
FIGS. 16 and 17 illustrate a spiral spring in the cutting tool of FIG. 1.
Figure 17:
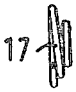
Figure 18:
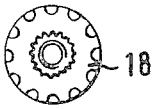
FIGS. 18 and 19 illustrate a knurled nut in the cutting tool of FIG. 1.
Figure 19:
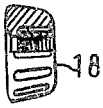

Referring to FIGS. 1 to 19, the first cutting tool 10 embodying the invention comprises a handle 11 in two parts 11/1 and 11/2, secured together by means of a screw 12. The screw 12 and handle part 11/1 are not shown, having been removed, in FIG. 4. Clamped between the handle parts 11/1 and 11/2 is a carrier member 13, shown by itself in FIGS. 5 and 6. A guide member 14 (FIGS. 7, 8 and 9) is secured to the carrier member 13 by means of a locator member 15 (FIGS. 10 to 13), which is secured to the carrier member 13 by means of bolts engaging in screw threaded apertures **15*a* and 15*b*. The bolt (not referenced) through aperture 15*b* also pivotally carries a clamp member 16 (FIGS. 14 and 15) a spiral spring 17 (FIGS. 16 and 17) and a knurled nut 18 (FIGS 18 and 19) the spring 17 being in between the clamp member 16 and the nut 18. Finally, a cutting blade 19 is clamped to the carrier member 13 by means of the clamp member 16, urged against the blade 19 by the spring 17 and nut 18**.

Figures 1, 2, 3:
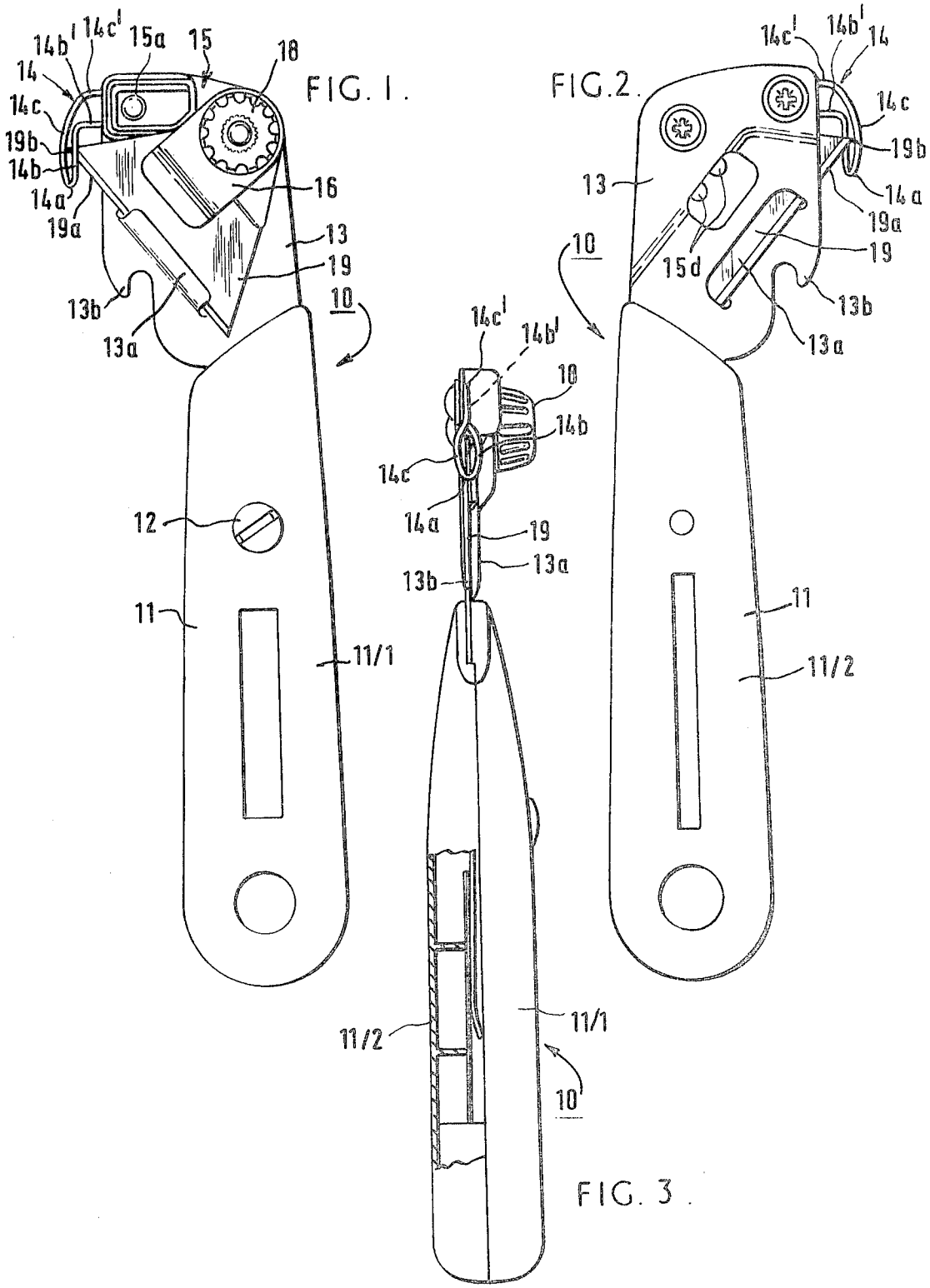
FIG. 1 is a side elevation of a first form of cutting tool embodying the invention.
FIG. 2 is an opposite side elevation of the cutting tool of FIG. 1.
FIG. 3 is an intermediate side elevation of the cutting tool of FIG. 1.

The guide member 14 is made of bent wire in the form of a loop to have a smooth (i.e. not sharp) rounded nose **14*a* projecting ahead of the cutting edge 19*a* (relative to the cutting direction, illustrated by arrows 20 in FIG. 22) and two arms 14*b* and 14*c* at opposite sides of the blade 19, the upper surface of one arm 14*b* being "above" and the lower surface of the other arm 14*c* being "below" the level of the tip 19*b* of the blade 19 as seen side on in FIGS. 20 and 21 and at the top in FIG. 22. The two arms 14*b* and 14*c* converge towards each other behind the blade 19, as shown in FIG. 3, so that the rear ends 14*b*' and 14*c*' are both directly behind the blade 19, one in front of the other, with extensions (formed by the rear ends 14*b*' and 14*c*') in line with the blade 19 connecting the two arms 14*b* and 14*c* respectively to a support for the blade formed by the carrier member 13 and the locator member 15. The locator member 15 is formed with a depression 15*c* (FIG. 11) to receive the extensions 14*b*' and 14*c*' of the guide member 14**.

Figure 4:
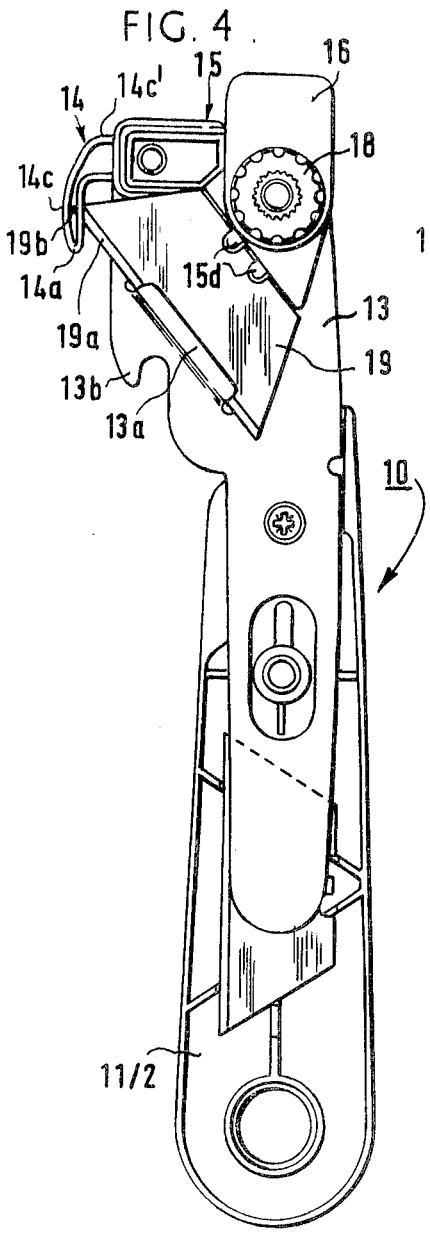
FIG. 4 is a view corresponding to FIG. 1, but with half of the handle removed and a clamp pivoted to unclamp the cutting blade.

The carrier member 13 is provided with a lipped slot **13*a* for the cutting edge 19*a* of the blade 19. For locating the blade 19, the locator member 15 is formed with two protrusions 15*d* which locate in corresponding notches in the blade 19 as shown in FIG. 4**.

For puncturing material which is too tough to be punctured by the rounded nose **14*a* of guide member 14, the carrier member 13 is formed with a rigid point 13*b***.

Figure 20:
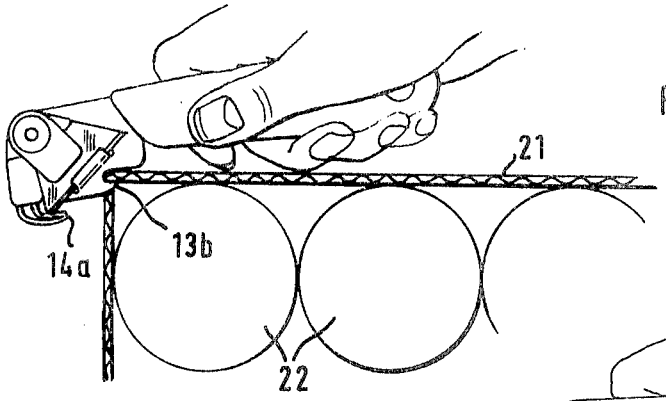
FIGS. 20, 21 and 22 illustrate use of the cutting tool of FIG. 1 for opening a cardboard carton.
Figure 21:
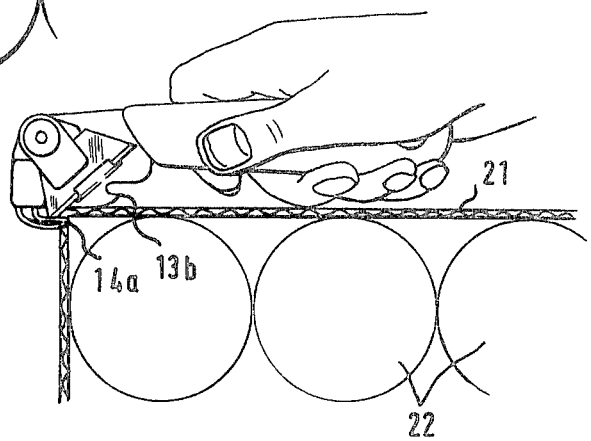

For opening a cardboard carton 21 (FIGS. 20 to 22) containing canned goods 22, assuming that the carton 21 is too tough to be punctured by the rounded nose **14*a* of guide member 14, the point 13*b* is used as shown in FIG. 20 to puncture the carton 21. Then the rounded nose 14*a* of guide member 14 is inserted as shown in FIG. 21, into the puncture made by the point 13*b*. Then the tool is moved by being pulled as shown in FIG. 22, to slit the carton open. Even if the canned goods 22 have the customary paper wrappers around the cans, the guide member 14 is most unlikely to damage them by tearing the wrappers, by virtue of the guide member being made of wire with no sharp edges, and particularly by virtue of its rounded nose. Additionally, being devoid of any exposed sharp edge or exposed sharp corner, there is little or no tendency for the guide member 14 to get clogged up with cardboard, and the tool is effective even if the cardboard has a somewhat higher than average moisture content. The lateral "spread" between the guide member arm 14*b* and the blade 19 (as seen in FIG. 3 and in FIG. 9) ensures that the guide member 14 remains on the inside of the carton 21 as the cutting tool is moved around the carton as shown in FIG. 22. Hence, no special effort is required to maintain the blade 19 in cutting engagement with the carton, all that is required being a firm pulling action, as illustrated in FIG. 22. The arm 14*b*, by having its upper surface above the level of the tip 19*b* of the blade 19, ensures that the blade 19 cuts right through the thickness of the cardboard forming the carton 21, since the arm 14*b* engages the inside of the cardboard material, so that the blade tip 19*b* has to project beyond the inside surface of the cardboard. However, damage to the cans is prevented by virtue of the lower surfaces of the arm 14*c* projecting below the level of the blade tip 19*b*, as seen in FIGS. 20 and 21 and at the top of FIG. 22 (for the orientation of the tool as shown) whereby the arm 14*c* shields the tip of the blade from the surfaces of the cans 22, provided that the tool is properly oriented as shown, relative to the cardboard sheet of the carton 21**.

Because the arm extensions **14*b*' and 14*c*' are in line with the blade 19, as shown in FIG. 3, they follow through quite easily as the blade 19 cuts through the cardboard. This follow through is also assisted by the distance between the blade cutting edge 19*a* and the nearer extension 14*b*', which is the length of the cut in the cardboard to allow the cut edges to separate for passage of the arm extensions 14*b*' and 14*c*'**.

Figure 22:
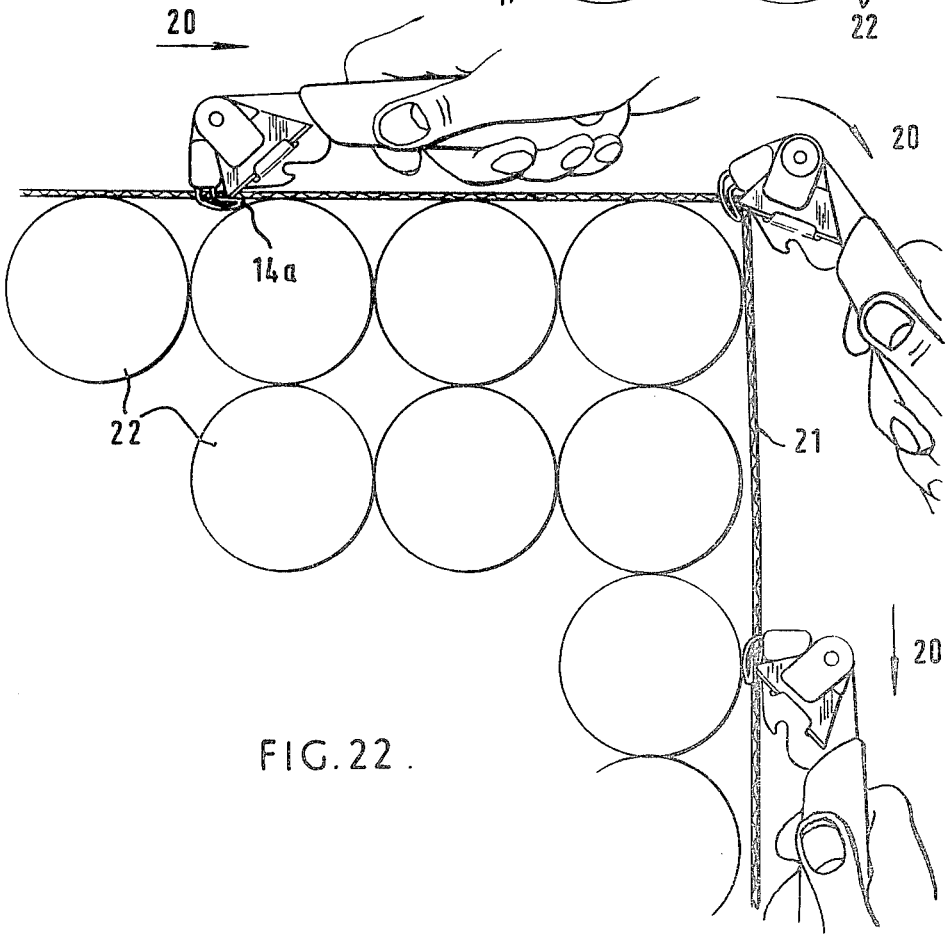
Figure 23:
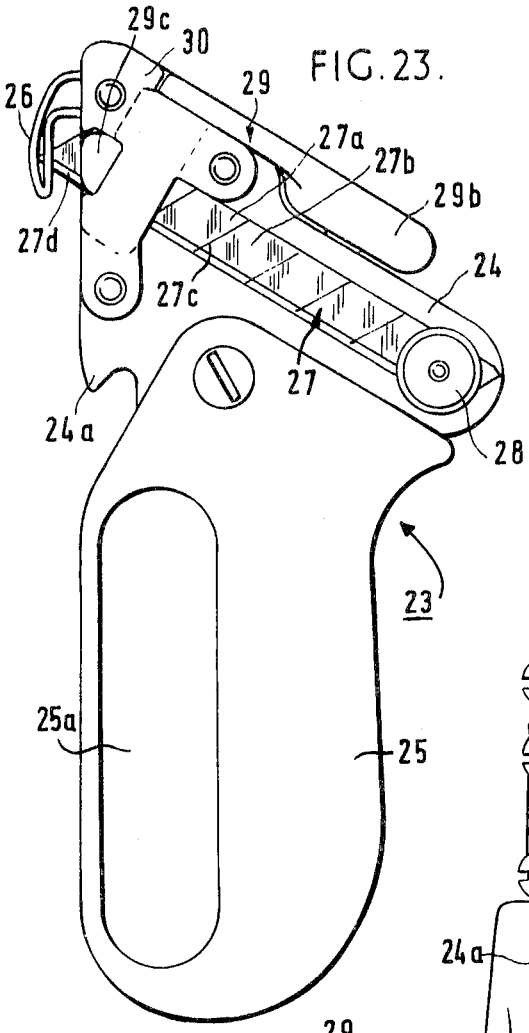
FIG. 23 is a side elevation of a second cutting tool embodying the invetion.
Figure 24:
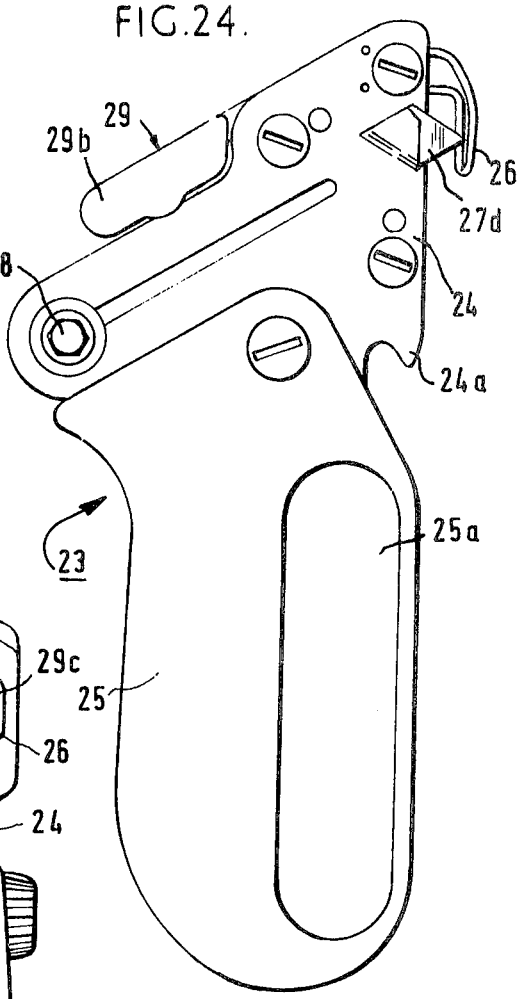
FIG. 24 is an opposite side elevation of the cutting tool of FIG. 23.
Figure 25:
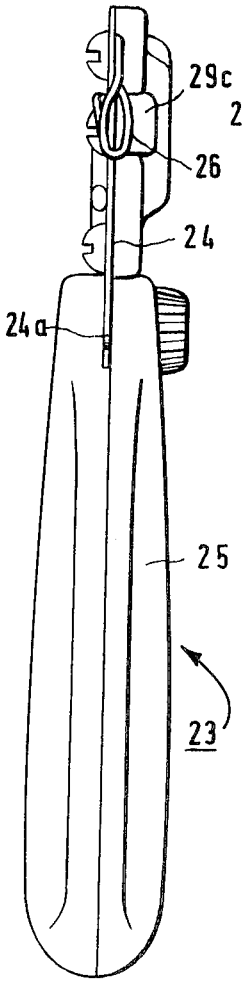
FIG. 25 is an intermediate view of the cutting tool of FIG. 23.
Figure 26:
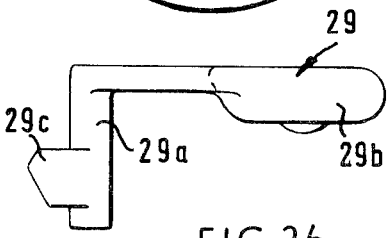
FIGS. 26, 27 and 28 illustrate a blade-snapping lever forming part of the cutting tool of FIG. 23.
Figure 27:
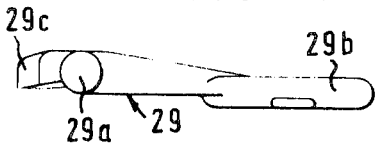
Figure 28:
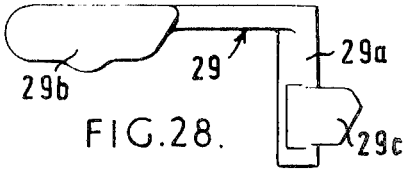

Additionally, the shape of the guide member 14, which is rather like a hook as seen in FIGS. 1, 2, 4 and 7, enables the cutting tool readily to negotiate the corner of the carton, as shown in FIG. 22. It also restricts access to the blade cutting edge **19*a*** so as to provide a measure of protection for the user, especially the user's fingers.

Referring to FIGS. 23 to 28, there is illustrated a second cutting tool 23 having many features similar to the tool 10 of FIGS. 1 to 22, but differing in a number of respects. Dealing firstly with similarities between the tool 10 of FIGS. 1 to 22 and the tool 23 of FIGS. 23 to 28, the tool 23 comprises a carrier member 24 which is of a different overall shape from the carrier member 13, but is still fixed to a handle 25 and includes a hook 24*a* of a similar shape to the hook 13*b* and having the same function. Furthermore, the tool 23 includes a guide member 26, the operative part of which (visible in FIGS. 23 to 25) has the same shape exactly as the operative part of the guide member 14, visible in FIGS. 1 to 3. However, the tool 23 comprises a composite cutting blade 27, in which a series of blades such as 27*a*, 27*b* are integrally joined together along already weakened lines of join, such as 27*c*, so that successive blades can be snapped off when they have become blunt through use, and a fresh blade brought into use by moving the composite blade 27 along and securing it in a new position by means of a clamping nut 28. The operative blade at any time is the front blade, such as the blade 27*d*, the cutting edge and blade tip of which are in the same relationship to the guide member 26 as the cutting edge and blade tip of blade 19 are in relation to the guide member 14.

A blade-snapping lever 29 (FIGS. 26 to 28) is pivoted on its shaft 29*a*, being clamped to the carrier member 24 by means of another member 30 (FIGS. 35 and 36) which is secured to carrier member 24 by three screws as shown. The blade-snapping lever 29 has a handle 29*b* for operation thereof and a nose portion 29*c* for engaging the operative blade such as 27*d* to snap the blade off, preferably after the blade has become blunt through use. In use, after the blade 27*d* has been snapped off by means of the lever 29, the nut 28 can be loosened and the blade 27 advanced to bring a new cutting edge into use.

The handle 25 is provided with a recess 25*a* for the fingers of the hand, to protect them against rubbing against the material being cut.

Figures 29, 30, 31, 32, 33, 34, 35, 36:
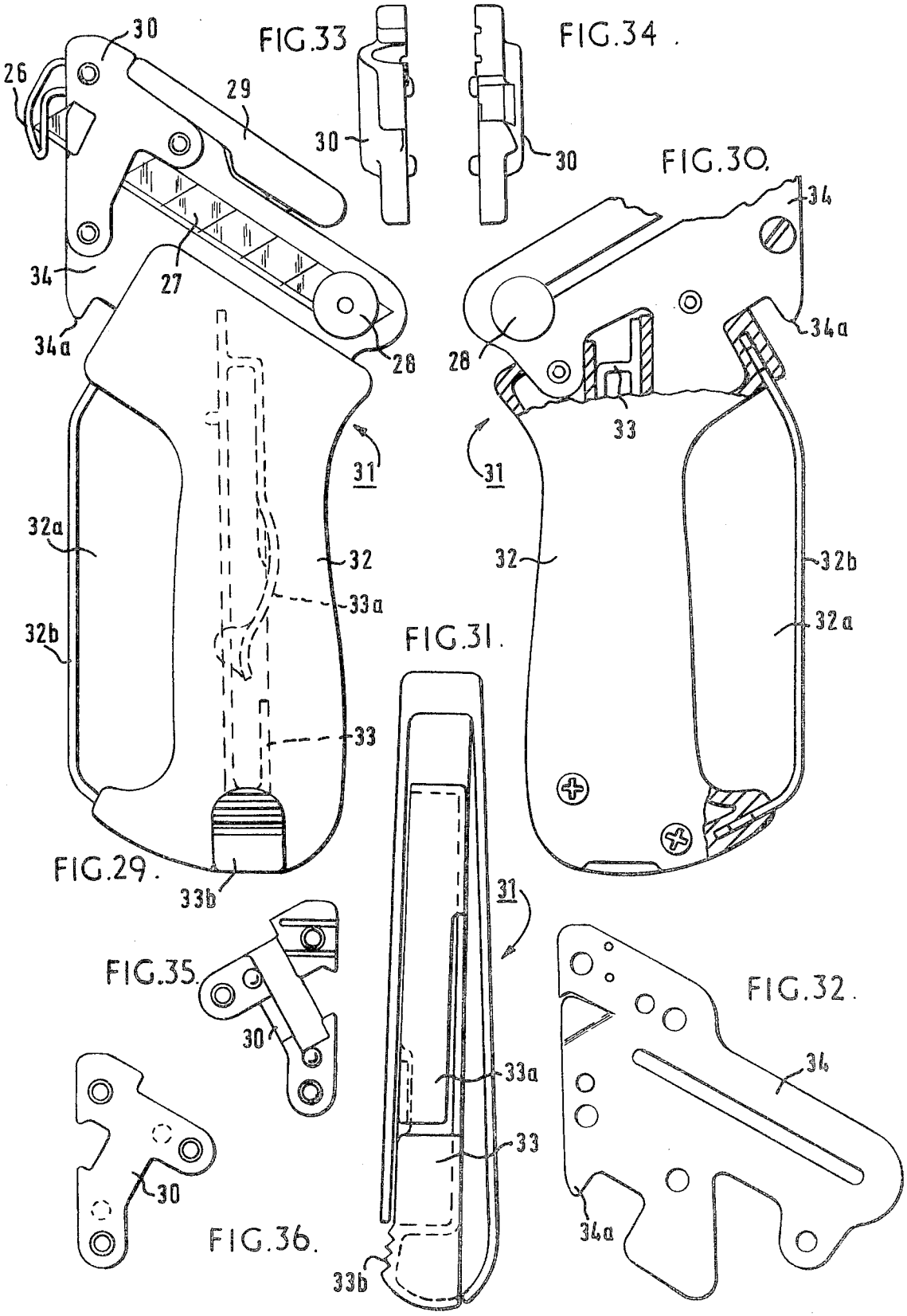
FIG. 29 is a side elevation of a third cutting tool embodying the invention.
FIG. 30 is an opposite side elevation of the cutting tool of FIG. 29, partly cut away and partly sectioned.
FIG. 31 illustrates a removable magazine for spare cutting blades in the cutting tool of FIG. 29.
FIG. 32 illustrates a carrier member forming part of the cutting tool of FIG. 29.
FIGS. 33 to 36 illustrate a locator member forming part of the cutting tool of FIG. 29.

The third cutting tool 31 illustrated in FIGS. 29 and 30 has many similarities with the second cutting tool 23, and like parts bear like references. This similarity applies to the guide member 26, the cutting blade 27, the blade-clamping nut 28, the blade-snapping lever 29, and the locator member 30.

The tool 31 has a handle 32 which differs from the handle 25 in that a finger-accommodating aperture 32*a* is defined by means of a metal or plastics strip 32*b* which is secured at both ends in the body of the handle 32, as shown in FIG. 30. Additionally, the handle 32 accommodates a captive magazine 33 (FIG. 31) for spare blades. The magazine 33 is provided with a resilient tongue 33*a* for holding the spare blades (not shown) securely to prevent them from rattling around, and includes an external portion 33*b* whereby it can be extracted partially from the handle 32.

Finally, the tool 31 comprises a carrier member 34 (FIG. 32) which differs somewhat in snape from the carrier member 24, but has the same function of carrying the guide member 26, blade 27, lever 29 and member 30. However, although the carrier member 34 is provided with a point 34*a* which is analogous in use to the point 24*a* of carrier member 24, the shape of the point 34*a* is somewhat different, for reasons of design.

I claim:

1. In a cutting tool for opening cardboard cartons and the like and having a blade with a cutting edge terminating in a tip, a handle for supporting the blade with means for securing the blade thereto, and a guide member therefor, said guide member comprising a pair of arms which are disposed laterally on opposite sides of the blade and are connected by an integral loop forming a rounded nose projecting ahead of the cutting edge of the blade in its cutting direction, the improvement wherein one of said arms extends outwardly of the tip of the blade to form a shield for the tip and the other arm extends inwardly of the tip of the blade to form an anvil for said cutting edge.

2. A device as defined in claim 1 wherein the guide member is formed of a relatively inflexible wire.

3. A device as recited in claim 1 wherein the two arms diverge rearwardly from the rounded nose and are laterally spaced from the blade, said arms converging behind the blade with the free ends thereof bent upwardly in the plane of the blade.

4. A device as recited in claim 3 wherein the free ends are displaced from each other in alignment with the cutting direction of the blade.

5. A device as recited in claim 1 wherein the blade comprises a plurality of segments integrally joined at score lines, and a pivoted lever mounted by the handle has a cam engageable with the end segment to laterally bias the segment to snap it off when the lever is pivoted.

* * * * *